US008220175B2

(12) United States Patent
Saeler

(10) Patent No.: US 8,220,175 B2
(45) **Date of Patent: *Jul. 17, 2012**

(54) RAILWAY CAR COUPLER HEAD CONTOUR GAUGE AND METHOD

(75) Inventor: Kevin S. Saeler, Stoneboro, PA (US)

(73) Assignee: McConway & Torley, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/884,440

(22) Filed: Sep. 17, 2010
(Under 37 CFR 1.47)

(65) Prior Publication Data

US 2011/0197461 A1 Aug. 18, 2011

Related U.S. Application Data

(63) Continuation of application No. 12/694,705, filed on Jan. 27, 2010, now abandoned.

(51) Int. Cl.
*G01B 5/20* (2006.01)

(52) U.S. Cl. ..... 33/546; 33/651

(58) Field of Classification Search ..... 33/1 Q, 33/546, 541, 651, 550, 551
See application file for complete search history.

(56) References Cited

U.S. PATENT DOCUMENTS

| | | | | |
|---|---|---|---|---|
| 491,174 | A * | 2/1893 | Hazlehurst | 33/541 |
| 606,851 | A * | 7/1898 | Ware | 33/651 |
| 2,039,086 | A * | 4/1936 | Kinne | 72/364 |
| D369,756 | S * | 5/1996 | Noel | D10/64 |
| 7,020,977 | B2 * | 4/2006 | Brueckert et al. | 33/651 |
| 7,059,062 | B2 * | 6/2006 | Brueckert et al. | 33/651 |
| 7,360,318 | B2 * | 4/2008 | Brueckert et al. | 33/645 |
| 7,861,433 | B2 * | 1/2011 | Saeler | 33/546 |
| 2003/0037422 | A1 * | 2/2003 | Brueckert et al. | 29/402.18 |
| 2007/0125510 | A1 | 6/2007 | Mautino et al. | 164/137 |
| 2007/0251908 | A1 * | 11/2007 | Utsumi | 213/75 TC |
| 2010/0024232 | A1 * | 2/2010 | Saeler | 33/546 |
| 2011/0197461 | A1 * | 8/2011 | Saeler | 33/546 |

FOREIGN PATENT DOCUMENTS

| | | |
|---|---|---|
| WO | WO 2009/142749 | 11/2009 |
| WO | WO 2010/014389 | 2/2010 |

OTHER PUBLICATIONS

International Search Report and Written Opinion; International Application No. PCT/US2011/021979; pp. 12, May 3, 2011.

* cited by examiner

*Primary Examiner* — Yaritza Guadalupe-McCall
(74) *Attorney, Agent, or Firm* — Baker Botts L.L.P.

(57) ABSTRACT

A railway car coupler head contour gauge includes a cylindrical portion configured to be rotatably coupled to a coupler head. The railway car coupler head contour gauge also includes a pulling lug gauging portion, and a contoured gauging surface that is configured to align with a contour face of a top pulling lug of the coupler head during gauging. The coupler head contour gauge may also include a convex portion configured to align with a buffing shoulder of the coupler head.

20 Claims, 4 Drawing Sheets

RAILWAY CAR COUPLER HEAD CONTOUR GAUGE AND METHOD

CROSS-REFERENCE TO RELATED APPLICATIONS AND PATENTS

This application is a continuation of U.S. patent application Ser. No. 12/694,705, entitled "RAILWAY CAR COUPLER HEAD CONTOUR GAUGE AND METHOD."

TECHNICAL FIELD

The present disclosure is related to railway car couplers, and more particularly to a method and device for gauging railway car coupler heads.

BACKGROUND

The type-E coupler is the standard coupler for railway freight cars. As the standard coupler, all producers of such couplers in the United States are required to produce the couplers to a standard specification. Standard railway car couplers should be completely interchangeable regardless of the manufacturer. Also, couplers from any manufacturer should be able to be readily joined to couplers from any other domestic manufacturer.

The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges. When gauges are applied to a coupler in a prescribed manner, it may be verified that certain dimensions of the coupler fall within an allowable variation or tolerance range.

For example, a pulling lug gauge can be pivotably attached to a coupler similar to the attachment of a knuckle. When the pulling lug gauge is rotated into a gauging position, the pulling lugs of a coupler should be positioned in certain lug receiving portions of the gauge. This ensures that the pulling lugs are located in a position that will allow the knuckle to properly operate and interface with the pulling lugs to support the draft forces of a railroad car. Current gauges may not be suitable to test all critical dimensions of a railway car coupler.

SUMMARY

The teachings of the present disclosure include a railway car coupler head contour gauge that is capable of gauging a contour on a face of a top pulling lug and a buffing shoulder of a railway car coupler head.

In accordance with a particular embodiment of the present disclosure, a railway car coupler head contour gauge includes a cylindrical portion configured to be rotatably coupled to a coupler head. The railway car coupler head contour gauge also includes a pulling lug gauging portion, and a contoured gauging surface that is configured to align with a contour face of a top pulling lug of the coupler head during gauging. The coupler head contour gauge may also include a convex portion configured to align with a buffing shoulder of the coupler head.

In accordance with a further embodiment of the present disclosure, a method of measuring a railway car coupler head includes rotatably coupling a coupler head to a coupler head contour gauge. The coupler head contour gauge includes a pulling lug receiving portion, a cylindrical portion, and a contoured gauging surface. The contoured gauging surface may be aligned with a contour face of a top pulling lug of the coupler head.

Technical advantages of particular embodiments of the present disclosure include the ability to inspect a front face contour of a railway car coupler head to ensure that a knuckle will fit properly to a railway car coupler and operate properly when coupling and decoupling railway car couplers attached to adjacent railway cars. This inspection may be accomplished using the same gauge that is used to inspect either a pulling lug or a buffing shoulder of a railway car coupler head. Thus, particular embodiments include a gauge that can simultaneously check for proper configuration and location of both the top pulling lug face and the pulling lug.

Further technical advantages of particular embodiments of the present disclosure include a part including a contoured surface that may be coupled to an existing pulling lug gauge using conventional coupling techniques, such as welding.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of embodiments of the disclosure will be apparent from the detailed description taken in conjunction with the accompanying drawings in which.

DETAILED DESCRIPTION

Example embodiments of the present disclosure and their advantages are best understood by referring to FIGS. 1 through 4 of the drawings.

Figure 1:
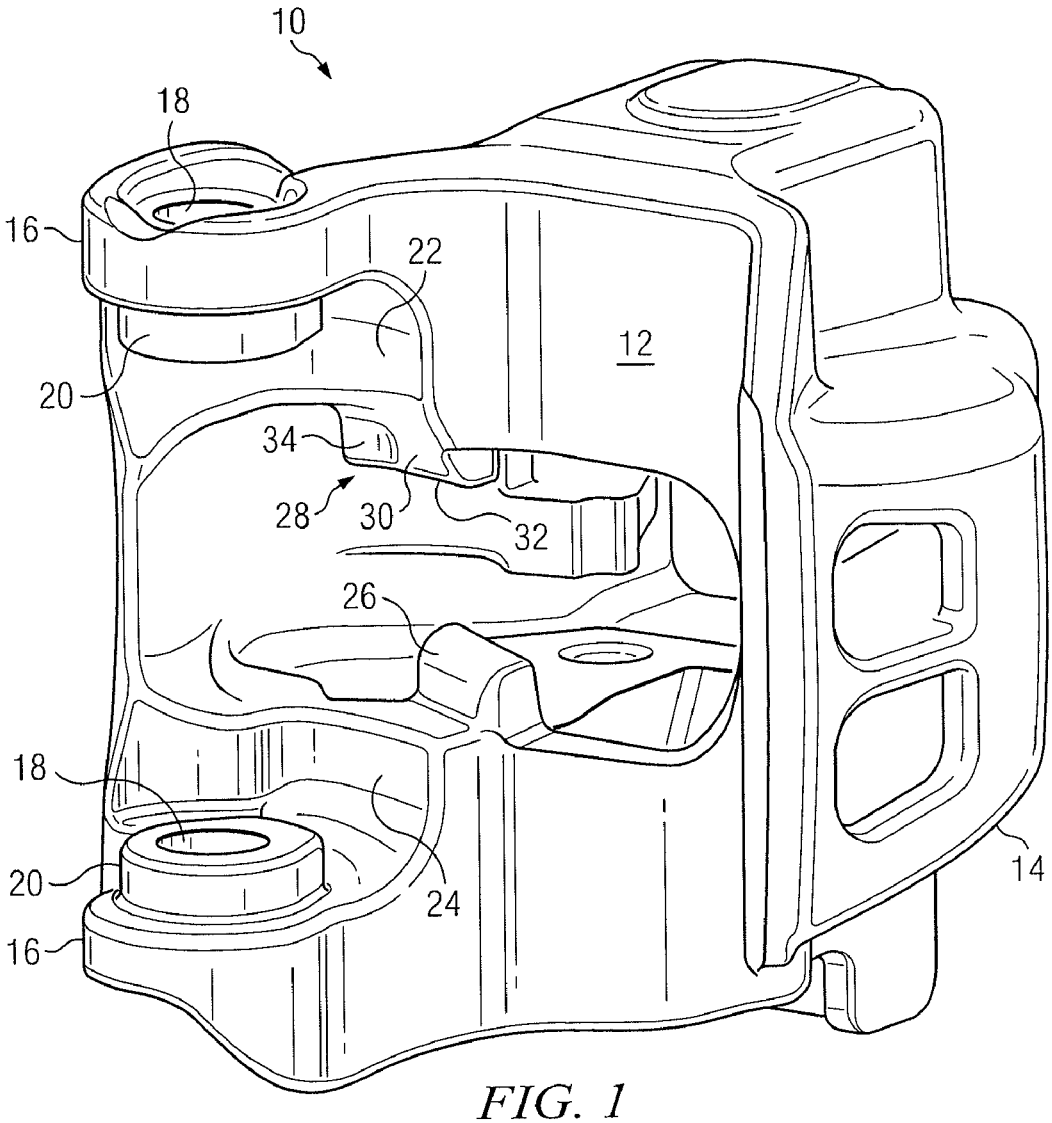
FIG. 1 is an isometric view of a railway car coupler head that may be gauged for operational compliance with an embodiment of the present disclosure.

FIG. 1 illustrates a railway car coupler head 10. Railway car coupler head 10 may be part of a type E coupler, a type F coupler, a type EF coupler, or another type of coupler. A type E coupler head is illustrated. Coupler head 10 includes guard arm 14. Opposite guard arm 14 is the knuckle side of coupler head 10. Between the knuckle side and guard arm 14 is front face 12.

Coupler head 10 may be configured to receive a knuckle (not shown). The knuckle may be received and retained in a pivotal manner with a pin (not shown) that extends through pinholes 18 of pivot lugs 16. The pin may be protected by pin protectors 20 when it extends through pinholes 18 and a corresponding pinhole in the knuckle. Located behind pivot lugs 16 are top buffing shoulder 22 and bottom buffing shoulder 24. Together, top and bottom buffering shoulders 22 and 24 form a pocket for receiving the knuckle. Buffing shoulders 22 and 24 may receive the transferred load from an interfacing surface of a knuckle when the railway car experiences buff (pushing) motions.

Extending from a lower portion of coupler head 10 adjacent bottom buffing shoulder 24 is bottom pulling lug 26. Extending from a top surface of coupler head 10 adjacent top buffing shoulder 22 is top pulling lug 28. At least a portion of top pulling lug 28 may be generally aligned with a portion of bottom pulling lug 26.

When a knuckle is assembled with coupler head 10, pulling lugs 26 and 28 may engage corresponding pulling surfaces of the knuckle. This engagement may allow pulling lugs 26 and 28 to receive a transfer draft load from a corresponding knuckle of a mating coupler on an adjacent railcar.

Top pulling lug 28 includes top pulling lug face 30. Top pulling lug face 30 is a contoured surface that generally extends from top buffing shoulder 22 to an underside 32 of top pulling lug 28. Adjacent top pulling lug face 30 is top pulling lug indentation 34.

In some situations, portions of this contoured surface of top pulling lug face 30 may become enlarged or deformed such that a knuckle may not properly attach to coupler head 10 or operate properly when attached. Accordingly, conformity of top pulling lug face 30 for proper knuckle attachment and operation may be assured using a contour gauge in accordance with an embodiment of the present disclosure.

Figure 1A:
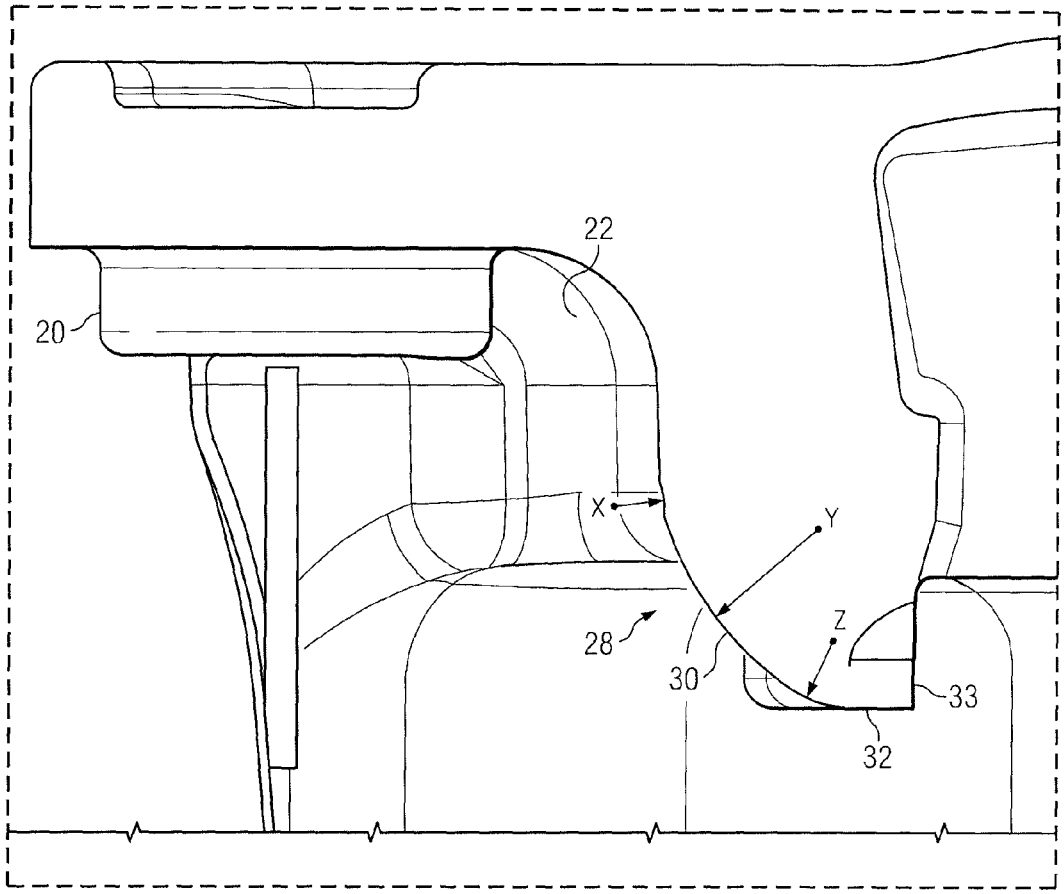
FIG. 1A is a side view, with portions cut away, of the railway car coupler head of FIG. 1 illustrating a top pulling lug.

The contour of top pulling lug face 30 is illustrated in FIG. 1A. It may be comprised of three portions, each having a different radius. A first radius X of an upper portion of top pulling lug 28 may be approximately 0.63 inches. This radius may transition into a second radius Y of a middle portion of top pulling lug 28 which may be approximately 2.75 inches. This 2.75 inch radius may transition into a third radius Z of a lower portion of top pulling lug 28 that may be approximately 1.00 inch. Other embodiments may include top pulling lug face contours having other suitable or desired dimensions, radii, or configurations. FIG. 1A also references a back surface 33 of top pulling lug 28. which may be gauged to ensure an appropriate configuration. Bottom pulling lug 26 may have a similar back surface that is similarly gauged.

The geometry and dimensions of the surfaces of coupler head 10 should allow proper assembly and operation of the knuckle. Thus, the geometry of coupler head 10 should be inspected to ensure that it will properly assemble with a knuckle. The inspection should also determine that the knuckle and coupler head 10 will operate properly. For example, the geometry and dimensions of top pulling lug 28 should not be allowed to impede the assembly with, and operation of, the knuckle.

The knuckle (and its identical counterpart on an adjacent coupler) may operate by contacting the guard arm of an adjacent coupler. In a joining operation, the knuckle of coupler head 10 and the opposing knuckle may each pivot inward to a degree sufficient to lock the two knuckles in place behind each other so that coupler head 10 is properly joined with the adjacent coupler. A lock member (not shown) slidably disposed within each coupler head 10, may be activated by the engagement to slide downward within the coupler head 10 and lock the knuckle in place to thereby join the two railway couplers together.

Coupler head 10 may be formed of a single, integral cast. It may be composed of quenched and tempered grade E steel. Due to the imprecise nature of the steel casting manufacturing process that may be used to form coupler head 10, the geometry of coupler head 10 should be inspected to ensure that coupler head 10 will assemble with a knuckle. The inspection should also determine that coupler head 10 will function properly when joined with other parts and/or mated with other couplers. It may also be necessary to ensure that coupler head 10 conforms to certain specifications.

Tolerances of coupler head 10 may be controlled using gauges to measure and confirm proper positioning and dimensions of certain features of coupler head 10. For example, if during casting, top pulling lug face 30 forms a sharp point, as opposed to a smooth contour, coupler head 10 may not properly receive, and be attached to, a knuckle. Moreover, even if the knuckle attaches to coupler head 10 it may not function properly because it may be impeded by the sharp point, deformity, or imperfection in top pulling lug face 30 which should be a smooth contour as described above.

Issues other than a sharp point of top pulling lug face 30 may be discovered through the use of a gauge according to an embodiment of the present disclosure. For example, if top pulling lug face 30 is allowed to expand during casting or subsequent finishing process, it may occupy what should be free space of coupler head 10 within which the knuckle should be allowed to move. This may cause the knuckle to operate improperly. That is, the knuckle may not be allowed to pivot correctly to allow coupling or decoupling of a mating coupler attached to an adjacent railway car.

Figure 2:
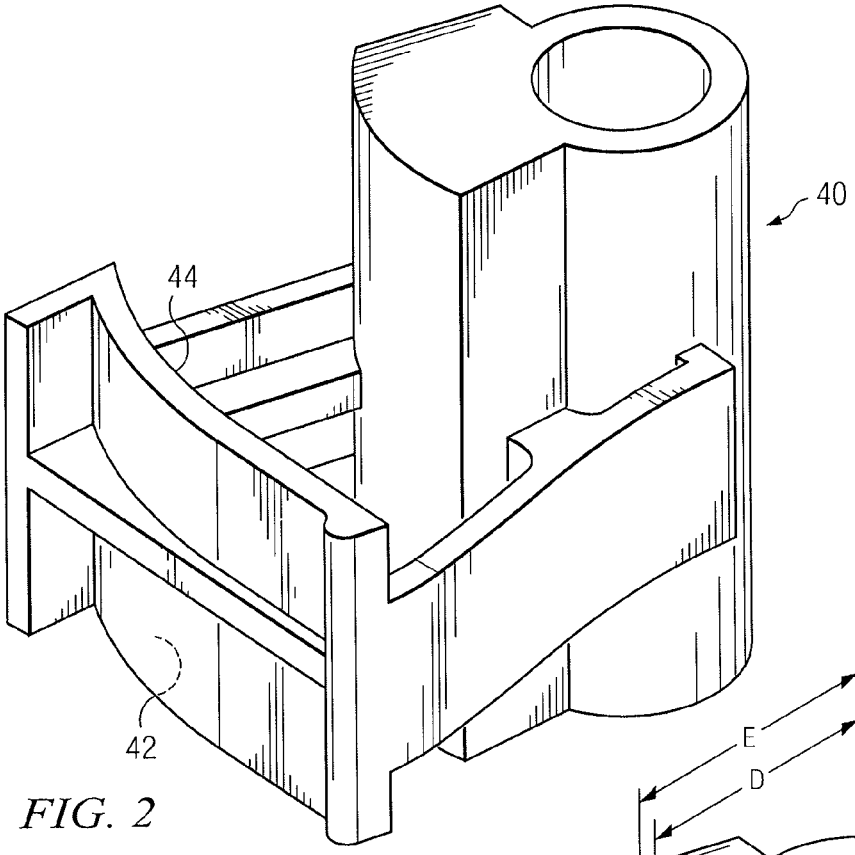
FIG. 2 is an isometric view of a conventional pulling lug gauge.

FIG. 2 illustrates a conventional pulling lug gauge (also sometimes referred to as a buffing shoulder gauge). Conventional pulling lug gauge 40 includes top pulling lug receiving portion 44 and bottom pulling lug receiving portion 42. The pulling lug receiving portions 42 and 44 gauge bottom and top pulling lugs 26 and 28 of coupler head 10 during a gauging operation. When conventional pulling lug gauge 40 is properly positioned in coupler head 10, it can be determined whether bottom and top pulling lugs 26 and 28 are properly formed and/or are in the proper position with respect to other features of coupler head 10. If conventional pulling lug gauge 40 properly fits in coupler head 10 and bottom and top pulling lugs 26 and 28 properly seat in pulling lug receiving portions 42 and 44, it may be determined that pulling lugs 26 and 28 have been properly formed and are in the proper position in coupler head 10. Conventional pulling lug gauge 40 may properly determine the correct position of bottom and top pulling lugs 26 and 28, but may not provide information about buffing shoulder 22 or pulling lug face 30.

Figure 3:
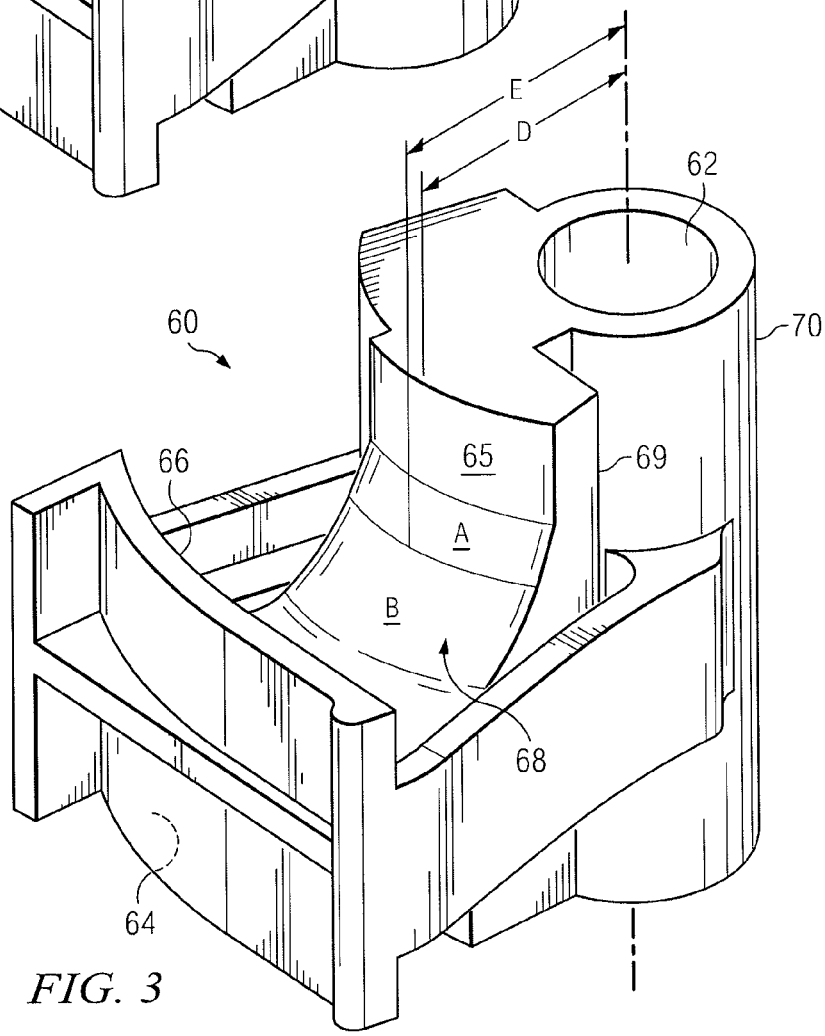
FIG. 3 is an isometric view of a pulling lug and contour gauge in accordance with a particular embodiment of the present disclosure.

FIG. 3 illustrates an instrument to gauge a contoured surface of top pulling lug 28 in accordance with an embodiment of the present disclosure. Pulling lug and contour gauge 60 may also be referred to as a buffing shoulder gauge. It may include contour gauging surface 68. Contour gauging surface 68 may include convex portion 65. Together, contour gauging surface 68 and convex portion 65 may allow gauging of top buffing shoulder 22 and top pulling lug face 30 in three dimensions. In accordance with a particular embodiment, conventional pulling lug gauge 40 may be modified to include contour gauging surface 68 thereby creating pulling lug and contour gauge 60. Pulling lug and contour gauge 60 may also include gauge pinhole 62, bottom pulling lug receiving portion 64 and top pulling lug receiving portion 66.

Contour gauging surface 68 includes radii A and B. Radii A and B may be any suitable radius that will allow contour gauging surface 68 to follow top pulling lug face 30. In certain embodiments, radius A may be approximately five-eighths (0.625) of an inch, and radius B may be approximately 2.75 inches. Each of radii A and B may have tolerances of plus or minus 0.002 inches or plus 0.004 inches in some embodiments. Radii A and B may be configured to follow the radii of top pulling lug face 30 allowing a small clearance of space between contour gauging surface 68 and top pulling lug face 30.

Radius A may correspond to the upper portion of top pulling lug 28, and radius B may correspond to a lower portion of top pulling lug 28. Contour gauging surface 68 may be dimensioned such that when pulling lug and contour gauge 60 is mated properly with coupler head 10, top pulling lug face 30 and top buffing shoulder 22 may be determined to be properly formed and present no hindrance to the assembly and operation of a knuckle coupled to coupler head 10.

Top pulling lug and contour gauge 60 may also include convex portion 65. Convex portion 65 may be located contour gauging surface 68 above the portion of contour gauging surface 68 having radius A. Convex portion may be shaped to align and with top buffing shoulder 22 of coupler head 10.

Contour gauging surface 68 may be a surface of contour gauging part 69. Contour gauging part 69 may be coupled to conventional pulling lug gauge 40. Such coupling may be accomplished by any suitable coupling technique, including welding contour gauging part 69 to pulling lug gauge face 66. Alternatively, pulling lug and contour gauge 60 may be formed of a single, integral casting or machined as a single, integral workpiece.

Pulling lug and contour gauge 60 may also include gauge pinhole 62 through cylindrical portion 70. Gauge pinhole 62 may receive a pin when pulling lug and contour gauge 60 is coupled to coupler head 10 to assure conformity of coupler head 10 to certain specifications. For example, when pulling lug and contour gauge 60 is attached to coupler head 10 an operator may rotate pulling lug and contour gauge 60 into position in coupler head 10 to ensure that there is either an proper fit or a clearance between gauging contour 68 and top pulling lug face 30.

In particular embodiments, a center-line of gauge pinhole 62 may be approximately 3.460 inches from the edge of contour gauging surface 68 (with a tolerance of −0.004 inches), as shown by dimension D on FIG. 3. In some embodiments, the center-line of the pinhole may be approximately 3.500 inches from the contour transition between radius A and radius B (with a tolerance of −0.004 inches), as shown by dimension E on FIG. 3.

As evident in FIG. 3, particular embodiments include a gauge that can simultaneously check for proper configuration and location of both the top pulling lug face and the pulling lug.

Figure 4:
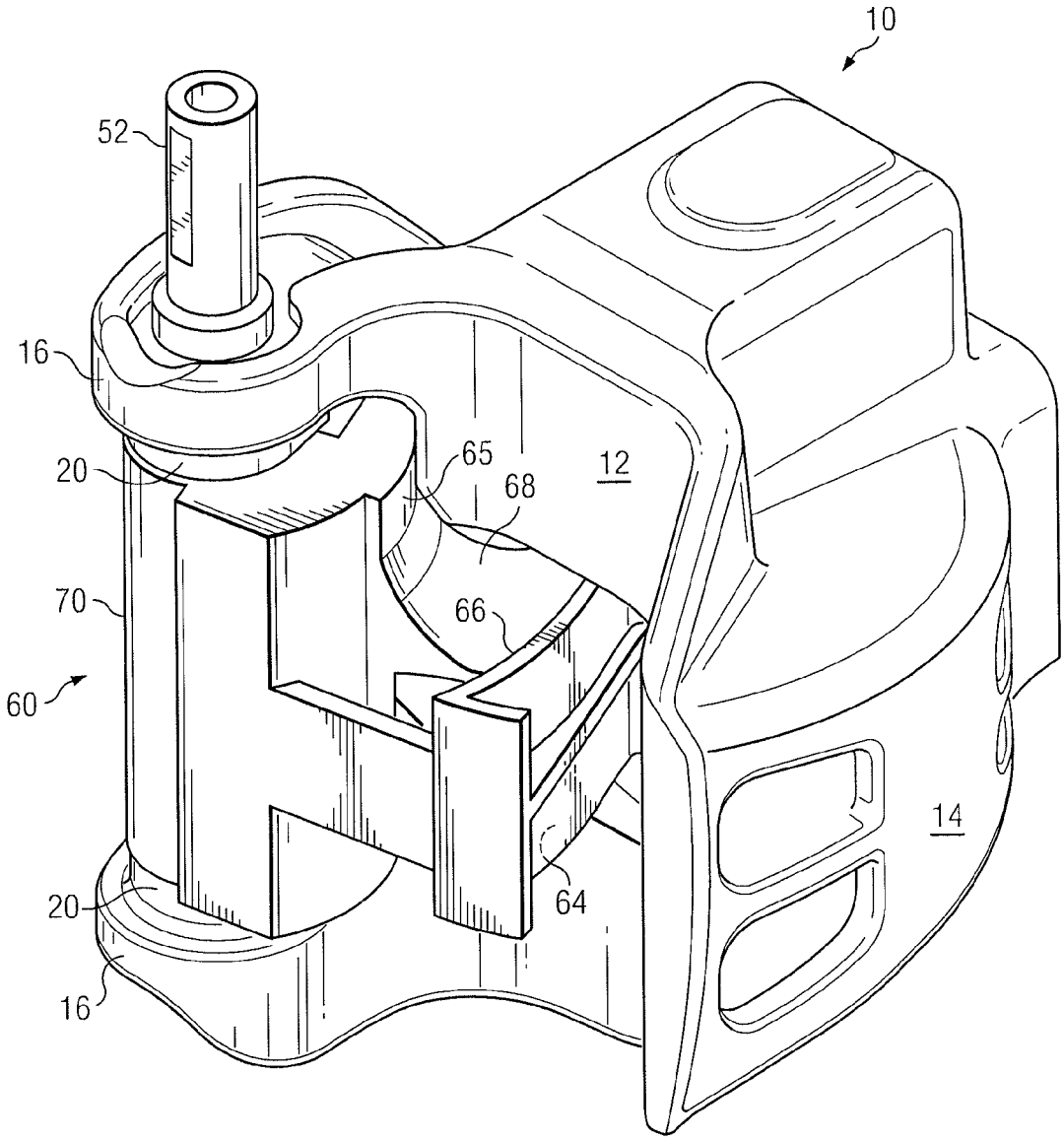
FIG. 4 illustrates a railway car coupler head and a pulling lug and contour gauge in accordance with a particular embodiment of the present disclosure.

FIG. 4 illustrates pulling lug and contour gauge 60 attached to railway car coupler head 10. Pulling lug and contour gauge 60 is shown rotated out from a gauging position in order to better illustrate its features and how they align with corresponding features of coupler head 10. Pulling lug and contour gauge 60 may be placed in gauging position by rotating it counter-clockwise from the position shown in FIG. 4. When pulling lug and contour gauge 60 is rotated counterclockwise, bottom and top pulling lugs 26 and 28 should mate with bottom and top pulling lug receiving portions 64 and 66.

Pivot pin gauge 52 may be received through pivot pinhole 18 and gauge pinhole 62. In this configuration, pulling lug and contour gauge 60 may be allowed to pivot about pivot pin gauge 52. When pulling lug and contour gauge 60 is rotated, contour gauging surface 68 should clear top pulling lug face 30 and buffing shoulder 22 of railway car coupler head 10. The clearance between contour gauging surface 68 and top pulling lug face 30 may be less than or equal to approximately 0.5 inches. In certain embodiments, this clearance may be less than approximately 0.25 inches. An acceptable railway car coupler head 10 may even lightly contact contour gauging surface 68 resulting in an acceptable fit. Thus, there may be no appreciable clearance in some cases. In some cases, the mere fact that there is any clearance such that the contour gauging surface 68 can rotate freely without contacting the top pulling lug face is acceptable, no matter how large the clearance.

However, if pulling lug and contour gauge 60 is unable to clear top pulling lug 28 or properly fit into coupler head 10 because contour gauging surface 68 is hindered by the shape of top pulling lug face 30, coupler head 10 may be rejected as failing to meet use specifications for railway couplers. In that case, the coupler head may be further machined or otherwise modified to meet the appropriate specifications.

Although the present disclosure and its advantages have been described in detail, it should be understood that various changes, substitutions, and alterations can be made therein without departing from the spirit and scope of the disclosure as defined by the appended claims.

What is claimed is:

1. A railway car coupler head contour gauge, comprising:
- a cylindrical portion configured to be rotatably coupled to a coupler head;
- a pulling lug gauging portion; and
- a contoured gauging surface configured to align with a contour face of a top pulling lug of the coupler head during gauging.

2. The railway car coupler head contour gauge of claim 1, wherein the contour face is located where a top buffing shoulder transitions into the top pulling lug of the coupler head.

3. The railway car coupler head contour gauge of claim 1, wherein the railway car coupler gauge comprises a single, integral body.

4. The railway car coupler head contour gauge of claim 1, further comprising a convex portion configured to align with a top buffing shoulder of the coupler head during gauging.

5. The railway car coupler head contour gauge of claim 1, wherein the contoured gauging surface comprises a first contour portion having a first radius greater than or equal to approximately 0.623 inches and less than or equal to approximately 0.627 inches.

6. The railway car coupler head contour gauge of claim 5, wherein the contoured gauging surface comprises a second contour portion having a second radius approximately equal to 2.75 inches.

7. The railway car coupler head contour gauge of claim 1, wherein the railway car coupler head contour gauge comprises steel.

8. The railway car coupler head contour gauge claim 1, wherein the cylindrical portion includes a pin hole therethrough, the pin hole being configured to receive a pin operable to rotatably couple the railway car coupler head contour gauge and the coupler head.

9. The railway car coupler head contour gauge of claim 1, wherein the contoured gauging surface is configured to ensure clearance between the contoured gauging surface and the contour face of the top pulling lug of the coupler head during gauging.

10. The railway car coupler head contour gauge of claim 9, wherein the contoured gauging surface is configured to allow for a clearance of approximately 0.25 inches between the contoured gauging surface and the contour face of the top pulling lug during gauging.

11. A method of measuring a railway car coupler head, comprising:
- rotatably coupling a coupler head to a coupler head contour gauge comprising a pulling lug gauging portion, a cylindrical portion, and a contoured gauging surface; and
- aligning the contoured gauging surface with a contour face of a top pulling lug of the coupler head.

12. The method of claim 11, further comprising forming a clearance between the contoured gauging surface of the railway car coupler gauge and the contour face of the coupler head.

13. The method of claim 12, wherein the clearance is less than or equal to 0.5 inches.

14. The method of claim 13, wherein the clearance is less than or equal to approximately 0.25 inches.

15. The method of claim 11, further comprising aligning the top pulling lug of the coupler head with the pulling lug gauging portion.

16. The method of claim 11, further comprising aligning a convex portion of the coupler head contour gauge with a top buffing shoulder of the coupler head.

17. The method of claim 11, wherein the contoured gauging surface comprises a first contour portion having a first radius greater than or equal to approximately 0.623 inches and less than or equal to approximately 0.627 inches.

18. The method of claim 17, wherein the contoured gauging surface comprises a second contour portion having a second radius approximately equal to 2.75 inches.

19. The method of claim 11, wherein rotatably coupling the coupler head to the coupler head contour gauge further comprises receiving a pin through a pin hole through the cylindrical portion.

20. The method of claim 11, further comprising aligning a bottom pulling lug of the coupler head with the pulling lug gauging portion of the coupler head contour gauge.

* * * * *